US007051878B2

(12) United States Patent
Randhawa

(10) Patent No.: US 7,051,878 B2
(45) Date of Patent: May 30, 2006

(54) PACKAGE RESTRAINT SYSTEM

(76) Inventor: Kuldip Randhawa, 12859 107 Avenue, Surrey, British Columbia (CA) V3T 2E8

( * ) Notice: Subject to any disclaimer, the term of this patent is extended or adjusted under 35 U.S.C. 154(b) by 0 days.

(21) Appl. No.: 10/286,785

(22) Filed: Nov. 4, 2002

(65) Prior Publication Data

US 2004/0031715 A1 Feb. 19, 2004

Related U.S. Application Data

(60) Provisional application No. 60/330,920, filed on Nov. 2, 2001.

(51) Int. Cl.
*B65D 81/02* (2006.01)

(52) U.S. Cl. ..... 206/583; 206/521

(58) Field of Classification Search ..... 206/423, 206/426, 443, 486, 490, 588, 589, 583, 597; 108/55.5, 55.3; 410/104; 211/74; 47/41
See application file for complete search history.

(56) References Cited

U.S. PATENT DOCUMENTS

| | | | | |
|---|---|---|---|---|
| 2,653,709 | A | 9/1953 | Cunningham et al. | |
| 3,180,607 | A | 4/1965 | Lee | |
| 3,375,793 | A | 4/1968 | Wagner | |
| 3,478,995 | A | 11/1969 | Lautzenhiser et al. | |
| 3,880,093 | A | 4/1975 | Schott | |
| 3,963,166 | A * | 6/1976 | Skimming | 206/588 |
| 4,013,020 | A * | 3/1977 | Schoeller et al. | 108/57.16 |
| 4,013,170 | A | 3/1977 | Hutterer | |
| 4,015,710 | A | 4/1977 | Biggs | |
| 4,574,955 | A | 3/1986 | Camossi | |
| 4,606,460 | A | 8/1986 | Luray | |
| 4,664,254 | A | 5/1987 | Sitwell et al. | |
| 4,809,848 | A * | 3/1989 | Rozmestor | 206/303 |
| 4,936,409 | A | 6/1990 | Nix et al. | |
| 5,111,950 | A | 5/1992 | Wylenzek | |
| 5,195,706 | A * | 3/1993 | Allen | 248/152 |
| 5,259,523 | A | 11/1993 | Scherb | |
| 5,285,902 | A | 2/1994 | Tabuenca Garcia | |
| 5,398,832 | A | 3/1995 | Clive-Smith | |
| 5,518,348 | A | 5/1996 | Tucker | |
| 5,533,456 | A | 7/1996 | Regina | |
| 5,549,341 | A * | 8/1996 | Chase et al. | 294/68.1 |
| 5,573,119 | A | 11/1996 | Luray | |
| 5,653,340 | A | 8/1997 | Daniel | |
| 5,655,662 | A | 8/1997 | Garcia | |
| 6,673,409 | B1 * | 1/2004 | Wheatley | 428/40.1 |

FOREIGN PATENT DOCUMENTS

| | | |
|---|---|---|
| DE | 3234139 | 3/1984 |

* cited by examiner

*Primary Examiner*—David T. Fidei
(74) *Attorney, Agent, or Firm*—Fasken Martineau DuMoulin LLP

(57) ABSTRACT

A package restraint system wherein a plurality of straps are secured around an item in a container for shipping purposes. A plurality of frictional pads and a plurality of flaps attached to the inner surfaces of the container further restrict any movement of the item in the container.

15 Claims, 3 Drawing Sheets

PACKAGE RESTRAINT SYSTEM

NOTICE REGARDING COPYRIGHTED MATERIAL

This application claims priority from U.S. Provisional Application Ser. No. 60/330,920 filed on Nov. 2, 2001 by Kuldip Randhawa and the entire disclosure of such provisional application is expressly incorporated herein by reference.

A portion of the disclosure of this patent document contains material which is subject to copyright protection. The copyright owner has no objection to the facsimile reproduction by anyone of the patent document or the patent disclosure as it appears in the public Patent Office file or records but otherwise reserves all copyright rights whatsoever.

TECHNICAL FIELD

This invention relates to a system for securing an item in a container to be shipped, and more particularly, a system using straps to prevent movement of the item in the container.

BACKGROUND

The need to secure items of various types, shapes, and sizes in a container to prevent damage to such items during the shipping process constantly arises. For example, retail stores frequently ship goods in containers to other retail stores or customers, and individuals commonly ship gifts in containers to friends and relatives. Although manufacturers typically provide product specific packaging designed to snuggly fit around the product to prevent potential damage during shipping, such product specific packaging may be unavailable when the product is subsequently shipped to another recipient. In such cases, the item must be placed within a container that may be considerably larger than the item itself and the problem of securing such item to restrict movement within the container occurs.

When shipping items where product specific packaging is not available, there are a multitude of ways to prevent damage to such items caused by shifting or sliding within the container. A common practice to restrict the movement of an item in a container is to fill the space between the container and the item with newspapers or other cushioning materials, such as styrofoam or bubble wrap, to create a buffer or protection zone around the item. However, such practice requires the sender to maintain a supply of newspapers or other cushioning materials and may be fairly time consuming, depending on the size of the item and the container.

Various devices designed to secure an item in a container exist in the prior art. For example, Lee, U.S. Pat. No. 3,180,607 discloses a multitude of anchor tabs secured to the container wall wherein ties are secured to such anchor tabs and such ties are then wrapped around an item and either secured to the container wall by adhesive means or tied together by a knot. Wylenzek, U.S. Pat. No. 5,111,950 discloses tie down brackets mounted on the base of the container wherein straps are secured to such tie down brackets and such straps are passed over the top of the item and secured to an opposing tie down bracket. Biggs, U.S. Pat. No. 4,015,710 discloses a container with a slotted base wherein removable straps with fasteners are passed through any two slots on such base to strap the item to the base.

The devices for securing an item in a container currently available in the art provide for a system of straps to secure the item in the container but they do not provide an additional flexible barrier to assist in securing the item.

SUMMARY OF THE INVENTION

It is an object of this invention to provide a package restraint system, namely a plurality of straps, frictional pads, and flaps which are used to secure an item in a container to prevent damage during the shipping purposes.

The present invention is a package restraint system having two embodiments. In the first embodiment, the system comprises a surface, a first and second semi rigid flexible flap on the surface, and a first and second strap attached to the first and second flap, respectively. The surface comprises an upper layer and lower layer wherein the first flap is formed from a first aperture on the upper layer and the second flap is formed from a second aperture on the upper layer. The first flap is opposed to the second flap and a frictional pad is attached to the upper layer between the first flap and the second flap. Each of the first and second flaps are pivotable towards each other and therefore engageable to an item positioned on the frictional pad. The first strap is securable to the second strap.

The method of restraining an item in a container according to the first embodiment involves positioning the item on the frictional pad and pivoting the first flap towards the second flap such that the first flap and the second flap engages the item. The first and second straps are then secured around the item and secured to each other.

In a second embodiment of the package restraint system, the system comprises a surface having an upper layer and a lower layer, a first and second semi rigid flexible flap on the surface, and a strap interposed between the upper layer and the lower layer. The first flap is formed from a first aperture on the upper layer and the second flap is formed from a second aperture on the upper layer. The first flap is opposed to the second flap and a frictional pad is attached to the upper layer between the first flap and the second flap. Each of the first and second flaps are pivotable towards each other and therefore engageable to an item positioned on the frictional pad. A first end of the strap is inserted through the first aperture and the second end of the strap is inserted through the second aperture. The first end and the second end of the strap are securable to each other.

The method of restraining an item in a container according to the second embodiment involves positioning the item on the frictional pad and pivoting the first flap towards the second flap such that the first flap and the second flap engages the item. The strap is then secured around the item and the first end and the second end are secured to each other.

BRIEF DESCRIPTION OF FIGURES

Further objects, features and advantages of the present invention will become more readily apparent to those skilled in the art from the following description of the invention when taken in conjunction with the accompanying drawings, in which.

DETAILED DESCRIPTION OF PREFERRED EMBODIMENTS

Figure 1:
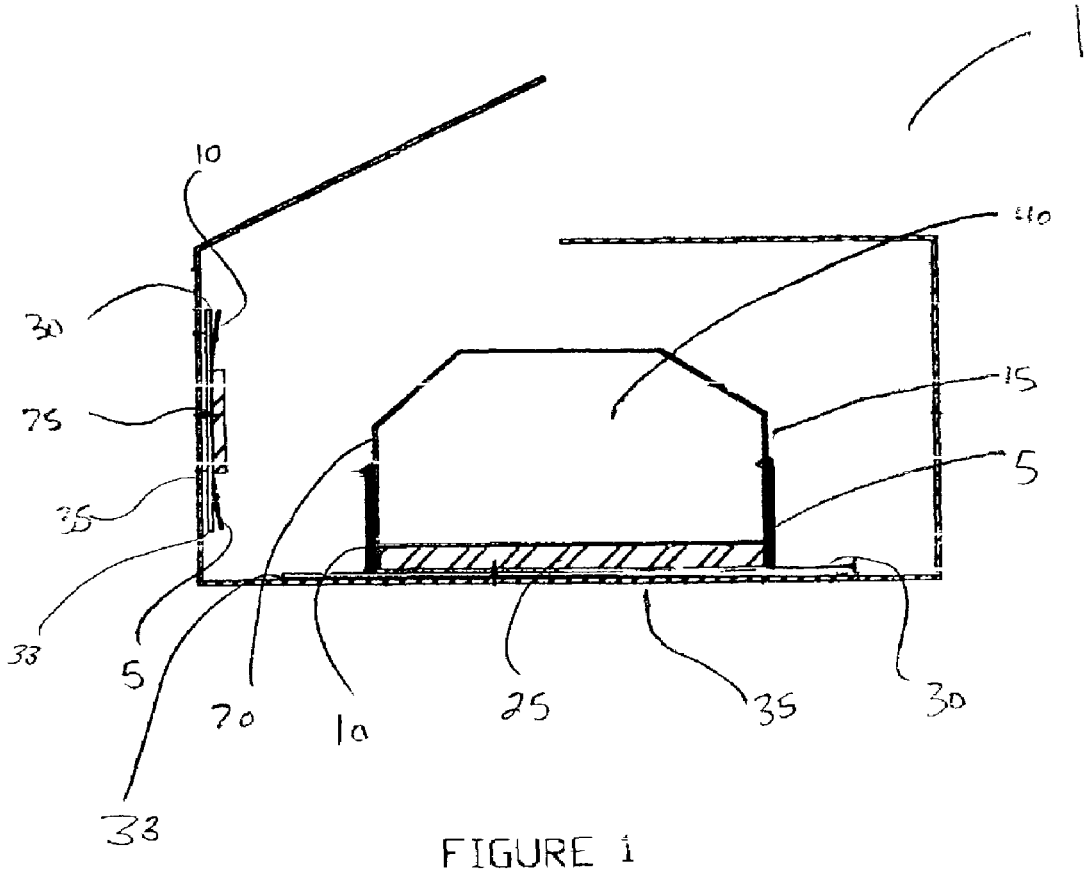
FIG. 1 is a cross sectional side view of a container incorporating an embodiment of a package restraint system according to the invention.
Figure 4:
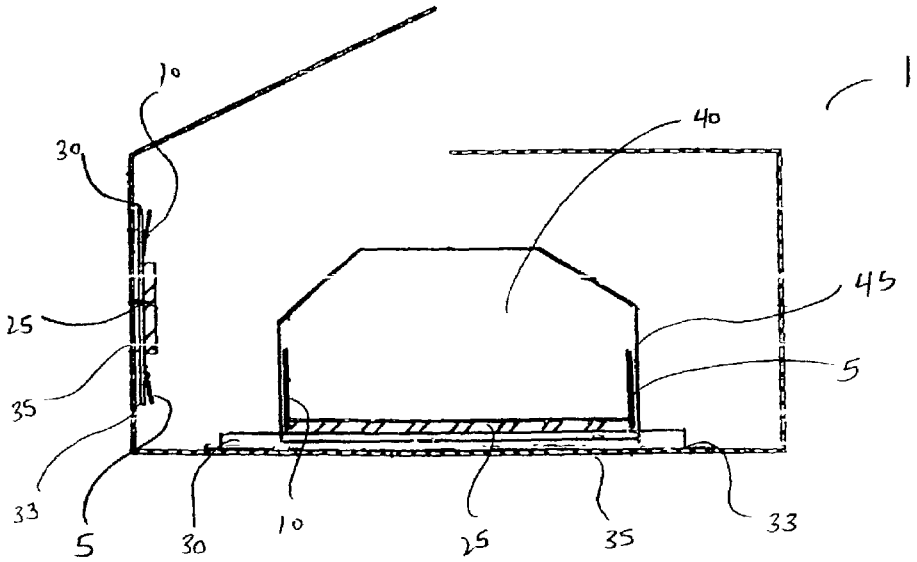
FIG. 4 is a cross sectional side view of a container incorporating an alternative embodiment of the invention.

The following detailed description will be made with reference to two preferred embodiments of a package restraint system, more particularly, an embodiment wherein a plurality of straps are attached to a plurality of flaps such that the free end of such straps are secured around an item (as seen in FIG. 1) and an embodiment wherein a strap is interposed between an upper layer and a lower layer of a surface such that the first end and the second end of the strap are inserted through a first and second aperture and secured around an item (as seen in FIG. 4).

Figure 2:
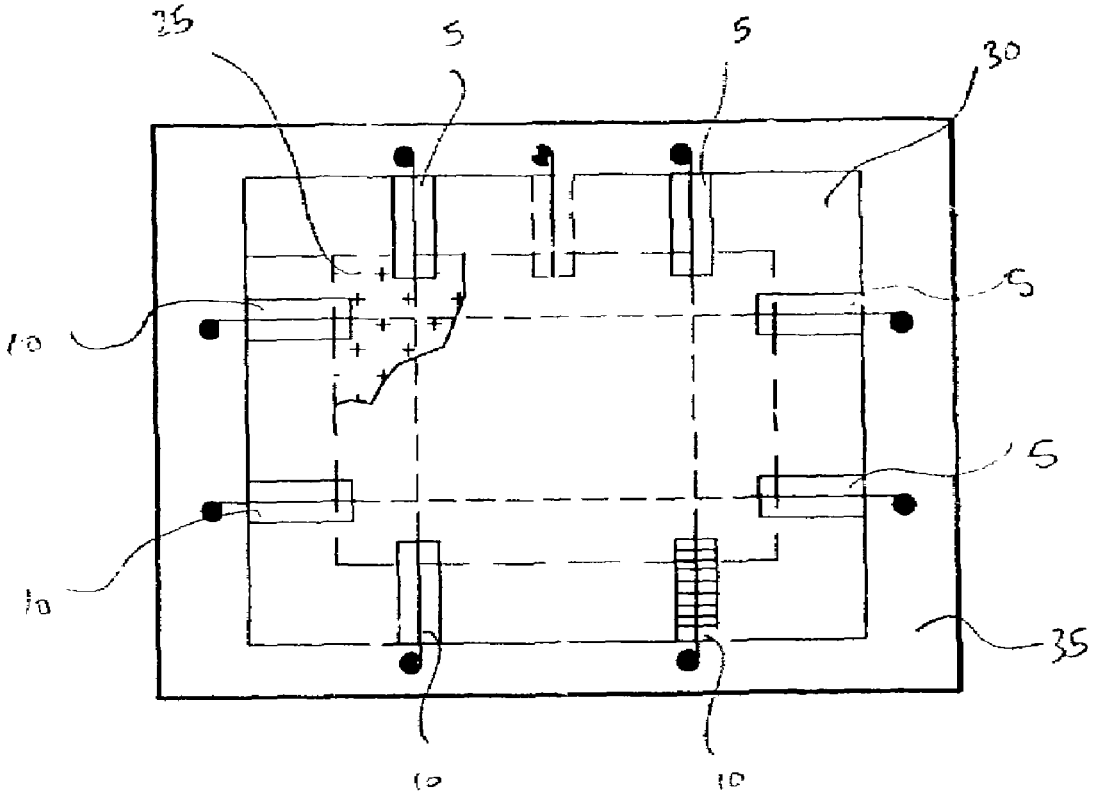
FIG. 2 is a top view thereof.
Figure 3:
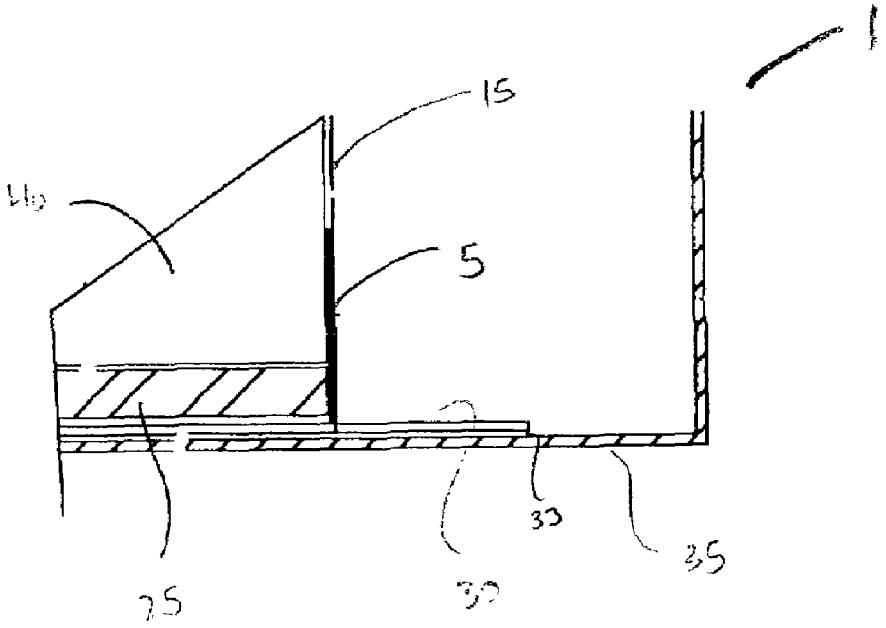
FIG. 3 is a detailed cross sectional side view thereof.

In an embodiment of the system, the package restraint system comprises first flap 5, second flap 10, first strap 15, second strap 20, and frictional pad 25 attached to upper layer 30 of surface 33, as seen in FIG. 1 and FIG. 3. First flap 5 and second flap 10 may be attached to lower layer 35 but preferably, first flap 5 and second flap 10 are formed from a first cut out and a second cut out, respectively, of upper layer 30 attached to lower layer 35 of surface 33. First flap 5 and second flap 10 are opposed and can be any size or shape so long as first flap 5 and second flap 10 can engage item 40 positioned in container 1. First flap 5, second flap 10, upper layer 30, and lower layer 35 can be made of any material capable of supporting the weight of item 40 positioned in container 1. Typically, first flap 5 and second flap 10 are made of a semi-rigid flexible material such as plastic or cardboard. Preferably, the surface of first flap 5 and second flap 10 which engage item 40 have grooves 18 to assist first flap 5 and second flap 10 in gripping item 40, as seen in FIG. 2.

First strap 15 and second strap 20 can be made of any material, such as cloth, plastic, string, metal strap, chain or twine. Preferably first strap 15 and second strap 20 are made of a flexible wire such that first strap 15 can be secured to second strap 20 by twisting first strap 15 and second strap 20 together. Alternatively, first strap 15 and second strap 20 may be made of plastic and further comprise a connector adapted to secure first strap 15 and second strap 20 together. First strap 15 is attached to first flap 5 and second strap 20 is attached to second flap 10 by conventional adhesive means. The length of first strap 15 and second strap 20 may vary depending on the size of container 1. The larger container 1 is, the longer first strap 15 and second strap 20 should be. Typically, a soft material such as foam or felt is attached to the surface of first strap 15 and second strap 20 to engage item 40.

Frictional pad 25 can be any slip resistant material but is preferably made of a layer of rubber or polystyrene based product to assist in maintaining item 40 in place. Frictional pad 25 is attached to upper layer 30 by conventional adhesive means and can be any size or shape so long as frictional pad 25 can be positioned between first flap 5 and second flap 10.

To use the package restraint system according to the embodiment described above, first flap 5 and second flap 10 are pivoted towards item 40 positioned on frictional pad 25 such that first flap 5 and second flap 10 engage item 40. First strap 15 and second strap 20 are then secured around item 40 and secured to each other. By securing item 40 by the method described, first flap 5, second flap 10, and frictional pad 25 prevent any horizontal movement of item 40 and first strap 15 and second strap 20 prevent any vertical movement.

Figure 5:
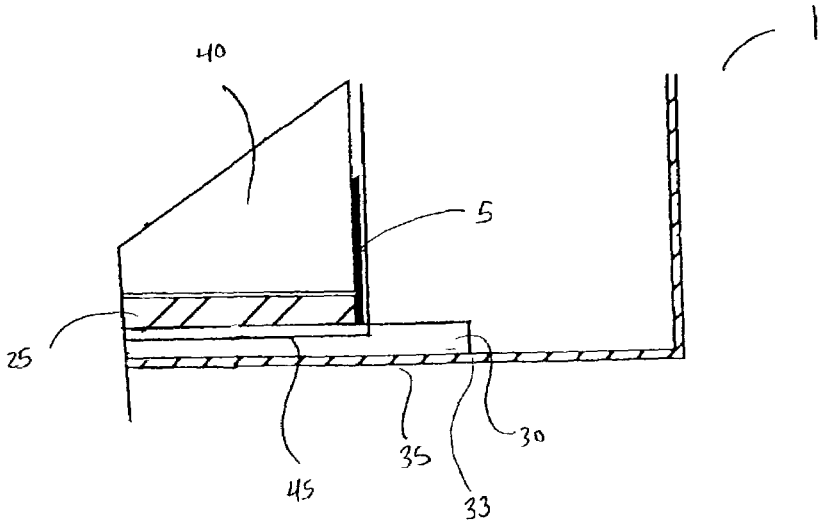
FIG. 5 is a detailed cross sectional side view thereof.

As seen in FIG. 4 and FIG. 5, a second embodiment of the package restraint system comprises first flap 5, second flap 10, strap 45, and frictional pad 25. The description of first flap 5, second flap 10, and frictional pad 25 are substantially the same as described above.

As seen in FIG. 5, strap 45 is interposed between lower layer 35 and upper layer 30 such that one end of strap 45 is inserted through the first aperture of the cut out to form first flap 5 and the second end of strap 45 is inserted through the second aperture of the cut out to form second flap 10. Similar to first strap 15 and second strap 20, strap 45 can be made of any material, such as cloth, plastic, string, metal strap, chain or twine. Preferably strap 45 is made of a flexible wire such that the first end of strap 45 can be secured to the second end of strap 45 by twisting the first end and the second end together. Alternatively, strap 45 can be made of plastic and further comprises a connector adapted to secure the first end of strap 45 and the second end of strap 45 together. The length of strap 45 may vary depending on the size of container 1. The larger container 1 is, the longer strap 45 should be. Typically, a soft material such as foam or felt is attached to the surface of strap 45 which engages item 40.

To use the package restraint system according to the second embodiment described above, first flap 5 and second flap 10 are pivoted towards item 40 positioned on frictional pad 25 such that first flap 5 and second flap 10 engage item 40. The first end of strap 45 and the second end of strap 45 are then secured around item 40 and secured to each other. By securing item 40 by the method described above, first flap 5, second flap 10, and frictional pad 25 prevent any horizontal movement of item 40 and strap 45 prevents any vertical movement In a variant of both of the described embodiments, the package restraint system can be positioned on any of the side surfaces of container 1. Also, the package restraint system can be an insert positionable in container 1. In yet another variant (as seen in FIG. 2) a multitude of opposing flaps 5, 10 and a multitude of straps 15, 20, 45 may be used as necessary to secure an item in container 1.

While the principles of the invention have now been made clear in the illustrated embodiments, it will be immediately obvious to those skilled in the art that many modifications may be made of structure, arrangements, and algorithms used in the practice of the invention, and otherwise, which are particularly adapted for specific environments and operational requirements, without departing from those principles. The claims are therefore intended to cover and embrace such modifications within the limits only of the true spirit and scope of the invention.

What is claimed is:

1. A package restraint system, comprising:

(a) a container having a bottom surface and a side surface;

(b) a first and second semi-rigid flexible flap on said bottom surface wherein said first flap is opposed to said second flap and each of said first flap and said second flap is pivotable towards the other;

(c) a first strap and a second strap attached to said first flap and said second flap, respectively, wherein said first strap is securable to said second strap;

(d) a third and fourth semi-rigid flexible flap on said side surface wherein said third flap is opposed to said fourth flap and each of said third flap and said fourth flap is pivotable towards the other; and (e) a third strap and a fourth strap attached to said third flap and said fourth flap, respectively, wherein said third strap is securable to said fourth strap.

2. The package restraint system of claim 1 wherein said first flap and said second flap are engageable to an item positioned on said bottom surface.

3. The package restraint system of claim 2 wherein said bottom surface is comprised of an upper layer and a lower layer.

4. The package restraint system of claim 3 wherein said first flap and said second flap are formed from a first aperture and a second aperture, respectively, on said upper layer.

5. The package restraint system of claim 4 wherein said first flap and said second flap have grooved surfaces which engages said item.

6. The package restraint system of claim 5 wherein a frictional pad is attached to said upper layer at a position substantially in between said first and second flaps.

7. The package restraint system of claim 6 wherein said first and second straps are padded on a first side of said first and second straps.

8. The package restraint system of claim 7 wherein said first and second straps are ties adapted to secure said item positioned on said upper layer by twisting said first strap and said second strap together.

9. A package restraint system, comprising:

(a) a bottom surface comprising first upper layer and a first lower layer;

(b) a first and second semi-rigid flexible flap on said first upper layer wherein:

(i) said first flap and said second flap are formed from a first aperture and a second aperture respectively on said first upper layer;

(ii) said first flap is opposed to said second flap; and (iii) each of said first flap and said second flap is pivotable towards the other;

wherein said first and second flaps are formed from a first strap interposed between said first upper layer and said first lower layer (d) a side surface comprising a second upper layer and a second lower layer;

(e) a third and fourth semi-rigid flexible flap on said second upper layer wherein:

(i) said third flap and said fourth flap are formed from a third aperture and a fourth aperture respectively on said second upper layer;

(ii) said third flap is opposed to said fourth flap; and (iii) each of said third flap and said fourth flap is pivotable towards the other;

(f) wherein said third and fourth flaps are formed from a second strap interposed between said second upper layer and said second lower layer.

10. The package restraint system of claim 10 wherein said first flap and said second flap are engageable to an item positioned on said bottom surface.

11. The package restraint system of claim 11 wherein said first flap and said second flap have grooved surfaces which engages said item.

12. The package restraint system of claim 12 wherein a frictional pad is attached to said first upper layer at a position substantially in between said first and second flaps.

13. The package restraint system of claim 13 wherein said first and second straps are padded on a first side of said first and second straps.

14. The package restraint system of claim 13 wherein said first strap is a tie adapted to secure said item positioned on said first upper layer by twisting a first end and a second end of said first strap together.

15. A method of restraining an item in a container comprising the steps of:

(a) providing a bottom surface and a side surface;

(b) providing a first and second semi-rigid flexible flap on each of said bottom surface and said side surface wherein:

(i) each of said first flaps is opposed to said second flap;

(ii) each of said first flap and said second flap is pivotable towards the other; and (iii) said first flap and said second flap engages an item positioned substantially adjacent to said bottom surface and said side surface;

(c) positioning said item substantially adjacent to said bottom surface and said side surface;

(d) engaging each of said first flaps and said second flaps to said item;

(e) securing a strap around said item; and (f) securing a first end of said strap to a second end of said strap.

* * * * *